United States Patent [19]

Howell

[11] Patent Number: 4,610,450

[45] Date of Patent: Sep. 9, 1986

[54] POOL TABLE

[76] Inventor: John N. Howell, General Delivery, Wasilla, Ak. 99687

[21] Appl. No.: 468,453

[22] Filed: Feb. 22, 1983

[51] Int. Cl.[4] ..... A63D 15/06

[52] U.S. Cl. ..... 273/3 A; 273/8; 273/12; 273/59 R

[58] Field of Search ..... 273/2, 3 R, 3 B, 4 R, 273/4 A, 4 B, 4 C, 5 R, 5 A, 5 B, 5 C, 6, 7, 8, 9, 10, 11 R, 12, 123 R, 3 A; D21/232

[56] References Cited

U.S. PATENT DOCUMENTS

| | | | |
|---|---|---|---|
| D. 217,370 | 4/1970 | Kooker | D21/232 |
| 606,546 | 6/1898 | Hayes | D21/232 |
| 1,443,266 | 1/1923 | King | 273/3 R |
| 3,463,489 | 8/1969 | Tretow | 273/3 R |
| 3,544,108 | 12/1970 | Bali | 273/3 A |
| 3,653,665 | 4/1972 | Wahlberg | 273/3 A |
| 3,700,235 | 10/1972 | Meyers et al. | 273/3 A |

FOREIGN PATENT DOCUMENTS

| | | | |
|---|---|---|---|
| 5258 | of 1889 | United Kingdom | 273/12 |

*Primary Examiner*—Richard C. Pinkham
*Assistant Examiner*—T. Brown
*Attorney, Agent, or Firm*—Rogers, Howell, Moore & Haferkamp

[57] ABSTRACT

A circular billiard or pool table having a plurality of pockets equally spaced around the table with the pockets being spaced radially inwardly from the perimeter of the table. A cushion rail around the perimeter of the table has inwardly projecting bumpers extending towards respective pockets, with the innermost edges of the bumpers being spaced from the respective pockets. The inwardly facing edge of the cushion rail forms a substantially concave smooth, continuous face between the bumpers.

16 Claims, 4 Drawing Figures

POOL TABLE

BACKGROUND OF THE INVENTION

1. Field

The present invention relates to pool or billiard tables and in particular to such tables which have a substantially round or circular playing surface.

2. State of the Art

The game of billiards or pool commonly utilizes a rectangular flat playing surface which is surrounded by a rectangular bumper. Pockets for receiving the pool balls are conventionally located in the bumper along the longitudinal sides of the table and at the corners of the table. Various other shapes for billiards or pool tables have been proposed. Polygonal tables are disclosed in U.S. Pat. Nos. 2,262,610 and 3,801,097 in which the pockets are positioned at each intersection of the sides of the polygon.

Circular billiard or pool tables are disclosed in U.S. Pat. Nos. 3,700,235 and 2,361,471. Pockets for receiving the pool balls are located in the curvilinear bumper at the perimeter of the circular playing surface. In U.S. Pat. No. 3,700,235 inwardly projecting bumper surfaces are positioned on the circular bumper between the pockets.

Pool tables having ellipitical playing areas are disclosed in U.S. Pat. Nos. 3,029,078; 3,315,960 and 3,463,489. The pockets for receiving the pool balls are located at one or both of the foci in U.S. Pat. Nos. 3,029,078 and 3,315,960. In U.S. Pat. No. 3,463,489, the playing area is formed by overlying elliptical boundaries which have a common focal point or mutually respective focal points are grouped near the center of the table, with pockets located at the other foci of the ellipses.

SUMMARY OF THE INVENTION

A unique billiards or pool table is provided on which conventional type pool games as well as a novel game, which is disclosed hereinafter, can be played. The table is circular and the top surface of the table forms the playing surface. A plurality of pockets are equally spaced around the table in a circle which is concentric with the circular table but has a diameter significantly smaller than the diameter of the circular table. Thus, the pockets are spaced inwardly from the perimeter of the table.

A cushion rail is provided adjacent to the perimeter of the circular table so that the cushion rail substantially surrounds the playing surface on the table. The cushion rail has a plurality of inwardly projecting bumpers, with mutually respective bumpers extending toward respective pockets. The innermost edges of the bumpers are spaced from the respective pockets so that each of the pockets is surrounded by playing space on the table. The inwardly facing edge of the cushion rail forms a substantially concave, smooth, continuous, cushioned, ball-engaging face or rail between the bumpers. In a preferred embodiment, the concave shape of the cushion rails between the bumpers is substantially elliptical.

Additional features of the invention will become apparent from the following detailed description taken together with the accompanying drawings.

THE DRAWINGS

Particularly preferred embodiments of the present invention representing the best mode presently contemplated of carrying out the invention is illustrated in the accompanying drawings, in which.

DETAILED DESCRIPTION OF THE ILLUSTRATED EMBODIMENTS

Figure 2:
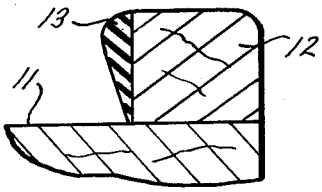
FIG. 2 is a cross-sectional view taken on line 2—2 of FIG. 1.
Figure 3:
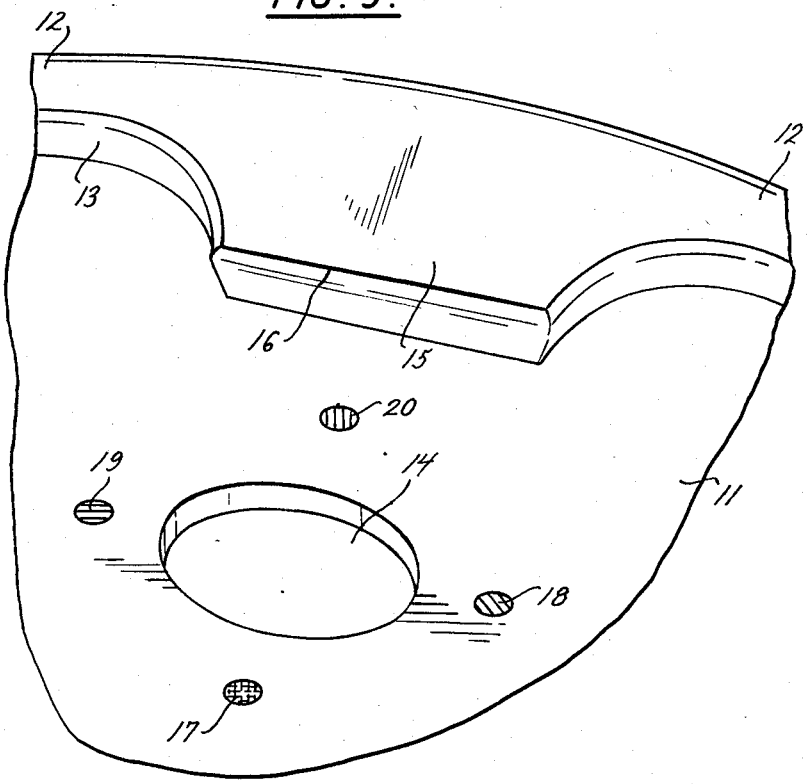
FIG. 3 is a pictorial view of a portion of the table of FIG. 1 showing one of the bumpers.

As illustrated, the pool or billiard table of the present invention has a flat, substantially circular playing surface 11. A cushion rail 12 is provided around the perimeter of the table or playing surface 11. The cushion rail is essentially round at its exterior edge which forms the round outer perimeter of the table. As shown in FIGS. 2 and 3, the cushion rail 12 comprises an upward extending rim of substantial rigid material such as wood or the like which is mounted on the perimeter of the table top or playing surface 11. Forming the inner curvilinear edge or face of the cushion rail 12 is a resilient cushion 13 of a rounded triangular cross-sectional shape as best shown in FIG. 2. As illustrated, the cushion 13 projects inwardly so that its rounded apex defines the innermost extent of the cushion rail 12 as well as the curvilinear periphery of the playing surface 11.

A plurality of pockets 14 are provided spaced equally about the table. The pockets 14 are located on an imaginary circle which is concentric with the circular table, but the imaginary circle has a diameter which is significantly smaller than the diameter of the circular table. Accordingly, the pockets 14 are spaced inwardly from the perimeter of the circular table. The actual diameters of the table and imaginary circle on which the pockets 14 are located can vary to suit personal preference. Generally, it has been found that a table of between 4 and 8 feet in diameter is preferred with a table of about 6 feet in diameter being a particularly preferred size. The diameter of the imaginary circle can be anywhere from about 0.5 to 0.8 that of the diameter of the table. The important criteria concerning the imaginary circle on which the pockets 14 are located is that the pockets 14 be inset from the perimeter of the table by sufficient dimension that the curvilinear shape of the inside face of the cushion rail 12 can be provided as described more fully hereinafter with the pockets 14 being spaced inwardly from the innermost edge of the inside face of the cushion rail 12. In a particularly preferred embodiment of the table of the invention, wherein the diameter of the table is about 6 feet, the diameter of the imaginary circle on which the pockets 14 are located is preferably about 3.5 to 4.25 feet.

As mentioned above, the cushion rail 12 substantially surrounds the playing surface 11 of the table at the perimeter of the table. The cushion rail 12 has a plurality of inwardly projecting bumpers 15, there being at least as many bumpers 15 as there are pockets 14. In the embodiment illustrated, there are four pockets 14 equally spaced 90 degrees apart from each other, and there are four bumpers 15 which are also 90 degrees apart from each other around the outside of the playing surface 11. Mutually respective bumpers 15 extend inwardly toward respective pockets 14, with the innermost edge of the bumper 15 being spaced from the respective pockets 14.

Each bumper 15 is associated with a respective pocket 14 such that the bumper 15 and its associated pocket 14 are in alignment along a radius from the center of the table through the respective pocket 14 and bumper 15. Thus, each associated pair of bumpers 15 and pockets 14 is aligned and positioned such that the pocket 14 is located adjacent to but spaced a relatively short distance from the innermost edge of the bumper 15 between the bumper 15 and the center of the table. Each bumper 15 is symetrical about a radius which extends through the respective pocket 14 with which the bumper 15 is associated. The spacing between the innermost edge of a bumper 15 and the center of its associated pocket 14 is between about 5 and 15 inches, preferably between about 7 and 12 inches.

Figure 1:
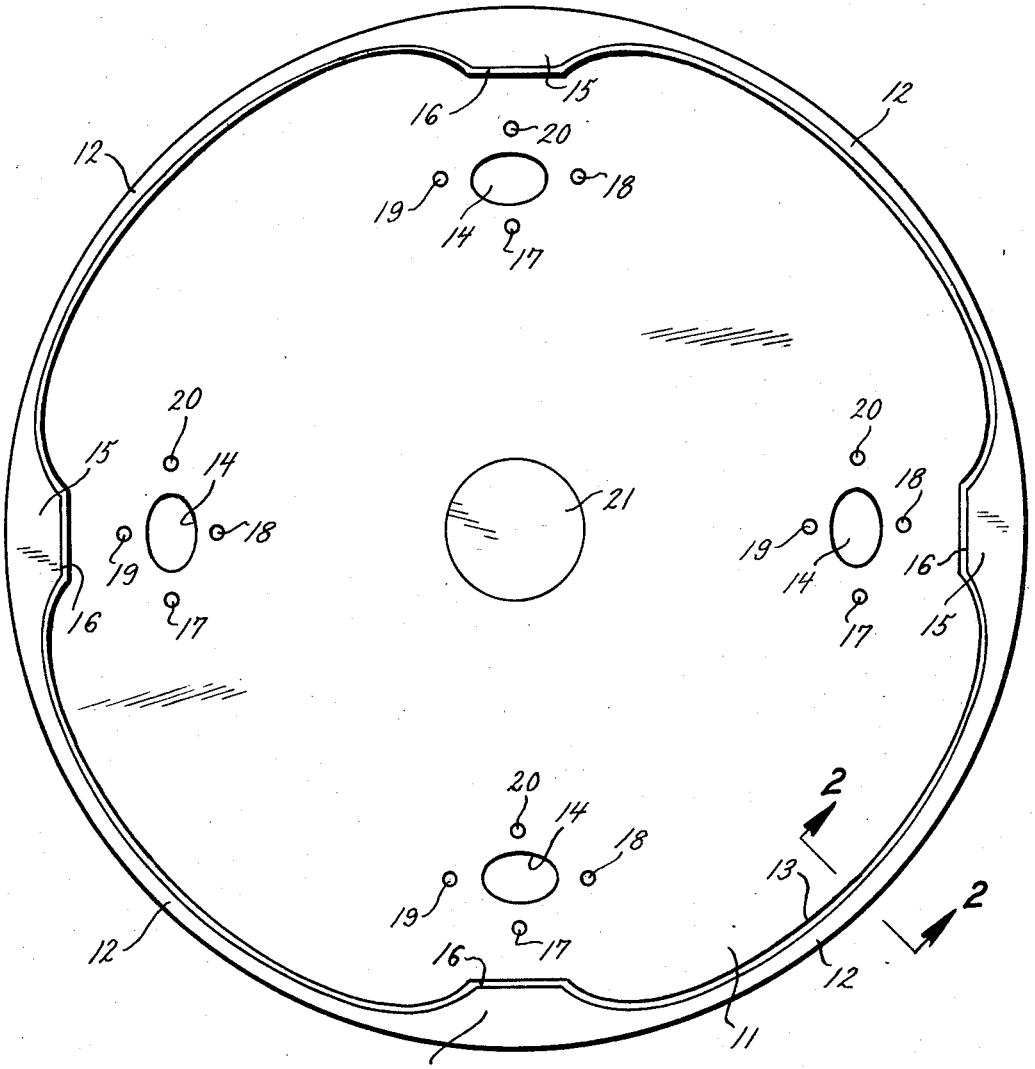
FIG. 1 is a top view of a table in accordance with the invention.

As best illustrated in FIG. 1, the inwardly facing edge of the cushion rail 12 between the bumpers 15 forms a substantially concave, smooth, continuous face or inwardly facing edge surface. As illustrated the concave shape of the cushion rails 12 between the bumpers 15 is substantially elliptical, with the long axis of the elliptical shape generally extending between the bumpers 15 at the opposite ends of the elliptical shape. The cushion rails 12 provide a smooth continuous surface between the bumpers 15 for the playing balls to hit and rebound. There are no sharp corners or other impediments in the cushion rails 12 between the bumpers, and because of the concave shape of the cushion rails 12 and the projecting bumpers 15, playing balls will not track around the entire perimeter of the table, but instead rebound onto the playing surface of the table after impart with the cushion rails 12 or track to the pocket of intersection.

As illustrated, the bumpers 15 which extend inwardly toward the respective pockets 14 have straight flat protruding edges 16 which face the respective pockets 14. In the embodiment as shown in the drawings, the elliptical surfaces between the bumpers 15 do not intersect each other, and thus the bumpers 15 at the ends of the elliptical shaped portions of the cushion rails 12 protrude inwardly toward the respective pockets 14 and form the flat surfaces 16 facing the respective pockets 14. As can be appreciated, the elliptical shapes of the cushion rails 12, although not illustrated, could be enlarged and lengthened such that the ends of the elliptical shapes would intersect, and the resulting bumpers 15 would project out to a point directed toward the respective pockets 14. In the preferred embodiment as illustrated in the drawings, the bumpers 15 protrude out to flat surfaces 16 facing respective pockets 14. The longitudinal length of the flat surfaces 16 is preferably from about 2.5 to 6 inches or more.

In the illustrated preferred embodiment the pockets 14 are elliptical in shape, with the long axis of each of the pockets 14 being normal to the radius of the table which extends through the center of the pocket 14. The longer length of the elliptical pockets 14 is preferably about 4 to 6 inches, and the cross width of the elliptical pockets is preferably about 3 to 5 inches. In one embodiment of the invention, the length of the flat surfaces 16 of the bumpers 15 is substantially the same as the longer length of the pockets 14 which the bumpers 15 face.

Colored indicia is preferably placed around each of the pockets 14. The colored indicia comprises four marks spaced around each of the pockets 14. The four marks of each pocket 14 are equally spaced around the respective pocket 14, with each of the four marks being of a different color. The four marks for each pocket 14 are located equidistant from the edge of the pockets 14. With the elliptical shaped pockets as illustrated, the marks are placed equidistant from the edge of the pockets on the long and short axes thereof. With circular shaped pockets, the colored marks are placed equidistant from the perimeter of the pocket on a radius line from the center of the table through the pocket and a diameter line through the pocket normal to the radius line.

The table illustrated in the drawings is particularly adapted to a novel unique game which will be described more fully hereinafter. For purposes of that game, a particular arrangement of the colored indicia is provided. The table has four equally spaced pockets, and each pocket will be associated with or identified by a particular color, such as red, blue, green, and yellow. Each pocket is identified with one of the colors by making the indicia on the side of the pocket facing the center of the table of the specified color. Thus, the pocket 14 at the top of the table as shown in FIG. 1 is identified with the color yellow by coloring the indicia shown by the number 17 yellow. The left and right hand pockets are identified with the colors green and blue, respectively, by coloring the indicia shown by the numbers 18 and 19 green and blue, respectively. The bottom pocket 14 is identified with the color red by coloring the indicia shown by the number 20 red. The colors of the indicia around each pocket 14 are further arranged so as to be in a certain order around the pockets 14. As can be seen, starting with any particular color on the pockets 14, going in clockwise direction, the same series of colors is obtained. For instance, starting with the color yellow, identified by the numeral 17, on any of the four pockets and proceeding clockwise you have blue, red, green and back to yellow.

The table is also provided in the preferred embodiment with a circular indicia 21 at the center of the table. The center circle 21 preferably has a diameter of between about 5 and 12 inches and will be used in the novel game as described hereinafter.

Figure 4:
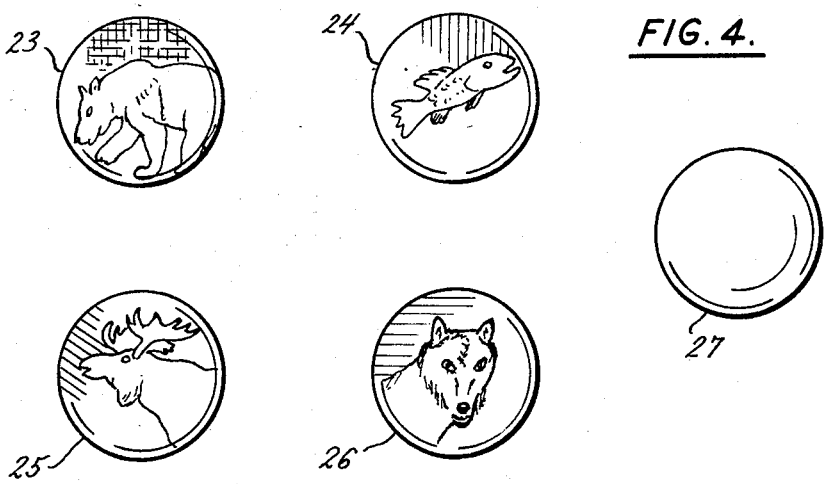
FIG. 4 is a pictorial view showing one each of the different object balls and one of four cue balls which is used in a particular game on the table of FIG. 1.

In the novel game, as disclosed herein, a table is used as shown in the drawings having four pockets and indicia as described above. In addition, four sets of object balls all of the same size are provided. The object balls are adapted to be received in the pockets 14. Each set of object balls consists of four balls all of the same color. The colors of the four sets correspond respectively to the colored indicia provided around the pockets 14, namely, yellow, green, blue and red. Thus, each set of object balls has a different color, with the colors of the four sets of object balls corresponding to the colors of the colored indicia located around the pockets 14. In addition, each object ball of the same color set has a distinctive additional mark thereon, with the marking on one set of object balls being the same with respect to the four balls in that set but being different than the marking on the balls of any of the other sets of object balls. A representative ball from each of the four sets of object balls is shown in FIG. 4. One of the balls, identified by numeral 23, is from the set of yellow balls and, as illustrated, has an image of a bear thereon. A second ball, identified by the numeral 24, is from the set of red balls and, as illustrated, has an image of a fish such as a salmon thereon. A third ball, identified by the numeral 25, is from the set of green balls and, as illustrated, has the image of a moose thereon. The fourth ball, identified by the numeral 26, is from the set of blue balls and has the image of a wolf thereon. Preferably, the images are reproduced on the balls 23–26 in duplicate on opposite sides of the balls.

In addition to the four sets of object balls there is provided a set of four cue balls. Each cue ball has a distinctive color corresponding to one of the colors of the four sets of object balls. A representative cue ball is shown by the numeral 27 in FIG. 4. The cue ball 27 is colored one of the colors of the four sets of object balls but otherwise has no other marking or indicia thereon. Although not shown, three other cue balls are provided, each being colored to correspond with one of the other colors of the four sets of object balls.

The unique game, which can be played using the table and balls as they are illustrated in the drawings, is commenced by placing the balls in their appropriate initial positions. The 16 balls comprising the four sets of object balls are placed on the colored indicia 17–20 around the pockets 14 on the table, with each object ball being placed on a colored indicia corresponding to the color of the ball. This is called "baiting the table".

As was noted above, each pocket 14 is assigned a particular color which is identified by the color of the indicia on the side of the pocket 14 facing the center of the table. A pocket 14 becomes a "den" for all object balls of the same color as that assigned to the pocket 14 and a "trap" for all object balls of a different color.

After the table has been "baited", the four cue balls are placed in the center circle 21 of the table. This circle is advantageously called the "turnagain". The players then choose a color which will identify the pocket 14 which becomes that person's den. The order of play is determined by selecting a player who is to be first. This can be done by different methods of chance, such as drawing straws, etc. The order of play is then set by the player's colors, moving clockwise from the first player's "den".

The object of the game is for each player to manipulate his object balls into his "den" while at the same time trapping other players object balls in his "den". It is noted that a player can "trap" other players object balls by manipulating the other players object balls into the other pockets 14 in the table which are not a "den" for the particular object ball being manipulated. Manipulation of the object balls is achieved by a player using a cue stick to propel his cue ball into the object balls as in conventional pool or billiards.

Total success in disrupting an opponent by manipulating all of the opponent's object balls into "traps" such that the opponent cannot get any of his balls into his own "den" is called a "sterling". Total success of one player being able to get all four of his own set of object balls into his "den" is called a "homer". Often times, however, all the object balls will be pocketed without any player being able to achieve a "homer" or a "sterling". Then the player with the greatest degree of success in pocketing his own balls and trapping other players' balls in his "den" will achieve an "anchor point". To defeat an opponent or opponents, one must achieve two "anchor points" in any three consecutive "baitings" of the table. A "sterling" will result in a win unless the losing player can produce a "homer" in the "baiting" following the "sterling". A "homer" is a win unless the losing players can force the next succeeding "baiting" into a "starisky". A "starisky" is achieved by the opponents being able to get all the object balls of all four sets into their respective "dens". The winner of the "starisky" is then determined by each player playing his cue ball against other players' cue balls to pocket such cue balls. The player with the last cue ball on the table is the winner of the "starisky".

Particular rules of play are as follows: (1) All play of a cue ball must start or restart from within the "turnagain" at the center of the table. (2) Once an object ball enters a "den" or "trap" they remain there. (3) If a cue ball enters a "den" or "trap", it can be returned to the playing area in accordance with the rules. (4) A player may intentionally or otherwise manipulate his cue ball into his own "den". In such instance, his play ends and he enters his cue ball back into play in the "turnagain" at his next turn. (5) If a player can manipulate an opponent's cue ball into a "trap", the opponent can return his cue ball to play in the "turnagain" only after losing one turn at play. (6) If a player manipulates his cue ball into a "trap", the player's turn is ended but his cue ball is immediately returned to the "turnagain" to be subject to attack by his opponents. (7) If a player does not pocket a ball in a "den" or "trap" on any single play, his play is ended and he must await his next turn to play again.

Although a preferred embodiment of the game apparatus has been illustrated and described, it is to be understood that the present disclosure is made by way of example and that various other embodiments are possible without departing from the subject matter coming within the scope of the following claims, which subject matter is regarded as the invention.

I claim:

1. A pool table comprising:

a substantially circular table, the top surface of which forms a playing surface;

a plurality of pockets equally spaced around the table, with said pockets located on an imaginary circle which is concentric with said circular table but has a diameter significantly smaller than the diameter of said circular table so that said pockets are spaced inwardly from the perimeter of said circular table;

a cushion rail adjacent the perimeter of said circular table so that the cushion rail substantially surrounds said playing surface, said cushion rail having a plurality of inward projecting bumpers, there being at least as many bumpers as there are pockets, with mutually respective bumpers extending inwardly toward respective pockets, wherein the innermost edge of said bumper is spaced from said pocket and the inwardly facing edge of said cushion rail forms a substantially concave, substantially elliptical, smooth, continuous face between said bumpers; and, colored indicia around each of said pockets, said colored indicia comprising four marks equally spaced about the respective pocket, each of said four marks being of a different color.

2. A pool table as claimed in claim 1, wherein the pockets are elliptical in shape with the long axis of each of said elliptical pockets being normal to a respective radius of said circular table extending through the center of said pocket, and said four marks for each pocket are located equidistant from the edge of said pocket on the long and short axes thereof.

3. A pool table as claimed in claim 2, wherein a circular indicia is provided at the center of the table.

4. A pool table as claimed in claim 1, wherein there are four pockets;

the table further includes four sets of object balls all of the same size, each set of object balls consisting of four balls all of the same distinctive color, with the color of one set of object balls being different from the colors of the other sets, further each set of object balls have the same distinctive marking thereon with the marking on one set of object balls being different than the marking on any other set of object balls;

the four marks comprising the colored indicia around each of said pockets are colored so that each mark of said four marks corresponds in color to the color of one of the sets of object balls; and a set of four cue balls with each cue ball having a distinctive color corresponding to one of the colors of said four sets of object balls.

5. A pool table comprising:

a substantially circular table, the top surface of which forms a playing surface;

a plurality of pockets equally spaced around the table, with said pockets located on an imaginary circle which is concentric with said circular table but has a diameter significantly smaller than the diameter of said circular table so that said pockets are spaced inwardly from the perimeter of said circular table;

a cushion rail adjacent to the perimeter of said circular table so that the cushion rail substantially surrounds said playing surface, said cushion rail having a plurality of inwardly projecting bumpers, there being at least as many bumpers as there are pockets, with mutually respective bumpers extending inwardly toward respective pockets, wherein the innermost edge of said bumper is spaced from said pocket and the inwardly facing edge of said cushion rail forms a substantially concave, smooth, continuous face between said bumpers; and wherein colored indicia are placed around each of said pockets, said colored indicia comprising four marks equally spaced about the respective pocket, each of said four marks being of a different color.

6. A pool table as claimed in claim 5, wherein the concave shape of said cushion rails between said bumpers is substantially elliptical.

7. A pool table as claimed in claim 5, wherein the pockets are elliptical in shape with the long axis of each of said elliptical pockets being normal to a respective radius of said circular table extending through the center of said pocket, and said four marks for each pocket are located equidistant from the edge of said pocket on the long and short axes thereof.

8. A pool table as claimed in claim 7, wherein a circular indicia is provided at the center of the table.

9. A pool table as claimed in claim 5, wherein there are four pockets;

the table further includes four sets of object balls all of the same size, each set of object balls consisting of four balls all of the same distinctive color, with the color of one set of object balls being different from the colors of the other sets, further each set of object balls have the same distinctive marking thereon with the marking on one set of object balls being different than the marking on any other set of object balls;

the four marks comprising the colored indicia around each of said pockets are colored so that each mark of said four marks corresponds in color to the color of one of the sets of object balls; and a set of four cue balls with each cue ball having a distinctive color corresponding to one of the colors of said four sets of object balls.

10. A pool table in accordance with claim 5, wherein said bumpers extending inwardly toward respective pockets have straight edges facing said respective pockets.

11. A pool table in accordance with claim 10, wherein the length of the straight edges of said bumpers is substantially the same as the width of the respective pockets which the bumpers face.

12. A pool table comprising:

a substantially circular table, the top surface of which forms a playing surface;

a plurality of pockets equally spaced around the table, with said pockets located on an imaginary circle which is concentric with said circular table but has a diameter significantly smaller than the diameter of said circular table so that said pockets are spaced inwardly from the perimeter of said circular table;

a cushion rail adjacent to the perimeter of said circular table so that the cushion rail substantially surrounds said playing surface, said cushion rail having a plurality of inwardly projecting bumpers, there being at least as many bumpers as there are pockets, with mutually respective bumpers extending inwardly and facing respective pockets, wherein the innermost edge of said bumper is spaced from said pocket and the inwardly facing edge of said cushion rail forms a substantially concave, smooth, continuous face between said bumpers, the cushion rail and bumpers forming means to track a ball around a portion of the table periphery and inwardly to the pockets of the respective bumpers.

13. A pool table as claimed in claim 12, wherein the concave shape of said cushion rails between said bumpers is substantially elliptical.

14. A pool table in accordance with claim 12, wherein said inwardly extending bumpers have straight edges facing said respective pockets and wherein the length of the straight edges of said bumpers is substantially the same as the width of the respective pockets which the bumpers face.

15. A pool table as claimed in claim 12, wherein the pockets are elliptical in shape with the long axis of each of said elliptical pockets being normal to a respective radius of said circular table extending through the center of said pocket.

16. A pool table as claimed in claim 15, wherein there are four pockets having distinctive indicia placed around each of said pockets, said indicia for each pocket being located equidistant from the edge of said pockets on the long and short axes thereof;

the table further includes four sets of object balls all of the same size, each set of object balls consisting of four balls, further each set of object balls have the same distinctive indicia thereon with the indicia on one set of object balls being different than the indicia on any other set of object balls;

one of each of the indicia around each of said pockets corresponding to the indicia of one of the sets of object balls;

a set of four distinctive cue balls; and wherein a circular indicia is provided at the center of the table.

* * * * *